US005566706A

United States Patent [19]

Harpenau

[11] Patent Number: 5,566,706

[45] Date of Patent: Oct. 22, 1996

[54] SIPHONING DEVICE TO ATTAIN DESIRED WATER LEVEL IN POOLS AND THE LIKE

[76] Inventor: Richard J. Harpenau, 17368 SE. Conch Bar Ave., Tequesta, Fla. 33469

[21] Appl. No.: 546,273

[22] Filed: Oct. 20, 1995

[51] Int. Cl.[6] ..... F04F 10/02

[52] U.S. Cl. ..... 137/152; 4/496; 137/142; 137/153

[58] Field of Search ..... 4/496, 508; 137/123, 137/142, 146, 152, 153, 797; 285/4

[56] References Cited

U.S. PATENT DOCUMENTS

| | | | |
|---|---|---|---|
| 3,969,777 | of/1976 | Beller . | |
| 4,453,749 | 6/1984 | McKinnon | 285/4 |
| 4,479,274 | 10/1984 | Biby | 137/142 X |
| 4,574,405 | of/1986 | Tams . | |
| 4,612,949 | of/1986 | Hensen . | |
| 4,655,243 | 4/1987 | Keller | 4/508 |
| 5,016,296 | of/1991 | Beaumont . | |
| 5,475,879 | 12/1995 | Miller | 4/496 X |

*Primary Examiner*—Gerald A. Michalsky

[57] ABSTRACT

A siphoning device used to attain the desired level of water in a swimming pool or other like pools of water that are either overfilled from rain water or from overfilling. A small simple plastic tubular device that is designed to connect to a regular garden hose and hang over the pool edge. A vertical soft plastic threaded tubular pick-up pipe exhibiting threads on one end connects into a vertically aimed threaded fitting of the device and extends into the water to be cut-off by user with a knife at the point that represents the users desired level of water for the pool. Upon filling of the garden hose with water and creating a natural gravity siphon action by locating the termination portion of the hose at a point in the yard that is horizontally a few inches or more lower than the desired pool level, water will be pulled or drained through the siphon device until pool water level reaches the level of the soft plastic pipe cut-off. At which time, the introduction of air into the hose will cease the siphon action and likewise the pool will not be drained any further.

1 Claim, 3 Drawing Sheets

SIPHONING DEVICE TO ATTAIN DESIRED WATER LEVEL IN POOLS AND THE LIKE

BACKGROUND—FIELD OF THE INVENTION

This invention relates to a siphoning device used to attain the desired level of water in a swimming pool or other like pools of water that are either overfilled from rain water or from overfilling. The present invention is particularly directed toward homeowners whom currently or probably drain their overfilled pool by simulating a backwash operation (using the pool equipment or filter motor/pump) thus washing out a garden bed or soaking a large area of grass. This form or practice causes some undesirable side effects, namely the introduction of the harsh pool chemicals into the garden soils or grass areas, wash-out of garden mulch, and in most cases, inaccurate levels are attained from lack of proper monitoring while the pump is running. The present device drains or lowers the water level very slowly and stops siphoning exactly at the users predetermined level. With the present device, the area of a garden or of the soil effected by the harsh pool chemicals could be as little as a square foot.

BACKGROUND—DESCRIPTION OF PRIOR ART

The use of water level control devises for maintaining a desired water level in a swimming pool or other pool of water is old and well known in the art. In fish ponds, generally a standing drain pipe comes out of the bottom of the pond and terminates at the desired level of water, where extra rain water is lowered or drained into the pipe as the water level increased. In some cases, pipes or drains are provided, constructed or inserted into the side of a pool (sometimes into the side of a pool skimmer housing) during the initial construction of a pool. When the water level would rise, these types of lateral overflow drains would relieve or allow the excess water to drain into the ground or leach bed, thus keeping the pool from overflowing. In most cases though, this simple pipe or drain is not initially installed and likewise, homeowners are faced with having to lower their pool water level several times per year due to excessive rains or from over filling.

The Beller U.S. Pat. No. 3,969,777 involves a similar wall drain device that is installed at the initial time of pool construction. As was explained above, if the homeowner failed to have this or similar device installed at time of pool construction, the present invention becomes very attractive from both a operational and economical viewpoint. The Henson U.S. Pat. No. 4,612,949 and the Tams U.S. Pat. No. 4,574,405 both involve elaborate devices for pool filling. They each will terminate the filling operation automatically upon the water level reaching a desired level. The present invention is strictly for lowering the water level, in which case the Henson and Tams devices do not apply.

The Beaumont U.S. Pat. No. 5,016,296 device is an auxiliary drain and filler for plastic pools. It is installed by penetrating the thin wall of a baby or similar plastic pool and is used to easily drain down such pool, alleviating the need to bucket the water out or from tipping the pool over when it is desired by someone to empty the water. The Beaumont device cannot be used by homeowners with a permanent or built-in pool. The Beaumont device is strictly for complete or partial drain-down or filling of a small plastic pool. The simple materials used in the construction of the Beaumont device are similar in some respect to the materials used to construct the present device, namely PVC (poly vinyl chloride) pipe fittings. The present pool siphon device is for lowering an overfilled pool to a more desired or average level for homeowners whom do not have a built-in wall or skimmer overflow drain like the Beller device.

The Keller U.S. Pat. No. 4,655,243 is also an elaborate automatic pool filler devise which like the Henson and Tams devices are for pool water filling and do not apply.

The Biby U.S. Pat. No. 4,479,274 is a swimming pool siphon device for draining an above ground swimming pool. The large U-shaped device has no resemblance to the present pool siphon device. The present device uses small diameter tubular parts, is very compact in size, is only used to lower the water level a few inches due to excessive filling or rain water, employs the use of a common garden hose and employs the use of a soft plastic threaded tubular pipe that may be cut-off by user at any length. The Biby device is designed to drain water from the very bottom of the swimming pool and the vertical legs are rigid and offer no means for draining only a couple inches of water from the top. The Biby device does not provide the user drain down of an overfilled pool to an exact predetermined water level. The bight portion, the siphon initialization procedure, the termination portions of the drainage leg or the pool leg of the Biby device have no resemblance in any way to the present device. Furthermore, the present device does not require or incorporate the use of any removable caps like the Biby device incorporates in three locations. Likewise the Biby device does not apply.

The Miller U.S. Pat. No. 5,475,879 is a open or above ground swimming pool overflow protector device that automatically controls the maximum fluid level in only an above ground pool. It also is used to completely drain down an above ground pool. The PVC device has to be located on the side of an above ground pool at the location or level of the desired water level and has no resemblance to the present pool siphon device in mechanics or appearance. The present device uses small diameter tubular parts, is very compact in size, is only used to lower the water level a few inches due to excessive filling or rain water, employs the use of a common garden hose and employs the use of a soft plastic threaded tubular pipe that may be cut-off by user at any length. The present device is used temporarily six to ten times a year when overfilling by rain occurs. Furthermore, the present device does not require or incorporate the use of any vents that is necessary for the overflow protection to function like the Miller device incorporates. Likewise the Miller device does not apply.

OBJECTS AND ADVANTAGES

Accordingly, besides the objects and advantages of the pool siphon described above, several objects and advantages of the present invention are:

a. to provide a homeowner a accurate device that is easy to set-up and inexpensive to purchase that would lower the water level of a pool or similar body of water;

b. to provide a means of lowering the water level of a pool or similar body of water slowly as to not widely distribute or to limit the distribution of harsh chemicals, common to swimming pool water, into the soil;

c. to provide the components and instruction that would assist a user or homeowner in achieving a gravity attained siphon action;

d. to provide the components and instruction that would assist a user or homeowner in lowering the pool water level from a undesired or overflowing level;

e. to provide a means of lowering the water level in a pool or similar body of water without causing damage or washout to owner or neighbors yard;

f. to provide a homeowner a water lowering device that would not need to be monitored in order to achieve a desired water level in the body of water being lowered;

g. to provide a homeowner a savings by providing a device that stops or terminates the siphon action automatically, thus there not being the need to refill a body of water that was unintentionally over-drained;

h. to providing a homeowner or user whom might use the pool pump and motor an alternate method of draining or lowering the water level;

i. to provide a small, easy to store and affordable device to accomplish a pool drain-down with accuracy, a chore that most pool owners consider as aggravating;

j. to provide a rugged and simple-in-construction device that can be effectively used without the requirement of any power source to accomplish a partial pool drain-down;

k. to provide a mechanism and procedure that may be performed by the average person as well as children with minimal training.

Further objects and advantages are to provide a homeowner the assurance that a predetermined water level will be achieved accurately. Another object of the present invention is to prevent wash-out to gardens and from dumping large amounts of harsh chlorine filled water into vegetated areas of the home owners or neighbors yard. An advantage of using this device would be the lack of required monitoring that is usually required when a motor assisted drain down is performed. After a heavy rain, pool owners commonly desire to lower the pool water level to a average height (about midway up the waterline tile). The present devise allows for a slow and precise draining operation. Slow is important as to not kill or cause unsuitable soil conditions to vegetation or wash out an area or a garden which usually is the by-product of using the pool motor to pump the water out or down. Precise is important because when the pool motor is used, it is common to wander off and forget the motor is running, consequently the pool is drained too far. A pump assisted drain-down can take approximately 20 minutes. Way too long for an active user to monitor, likewise the user will wander off and tackle other yard related projects and forget he is draining the pool with the pool pump.

Other characteristics, advantages and objects of this invention will be apparent from the following more particular description of a preferred embodiment of the invention as illustrated in the accompanying drawings. These descriptions forms a part of the specification wherein like reference and characters designate corresponding parts in several views.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like reference numerals depict like elements throughout the several views. The drawings are briefly described below.

DESCRIPTION—FIGS. 1 to 5

Figure 1:
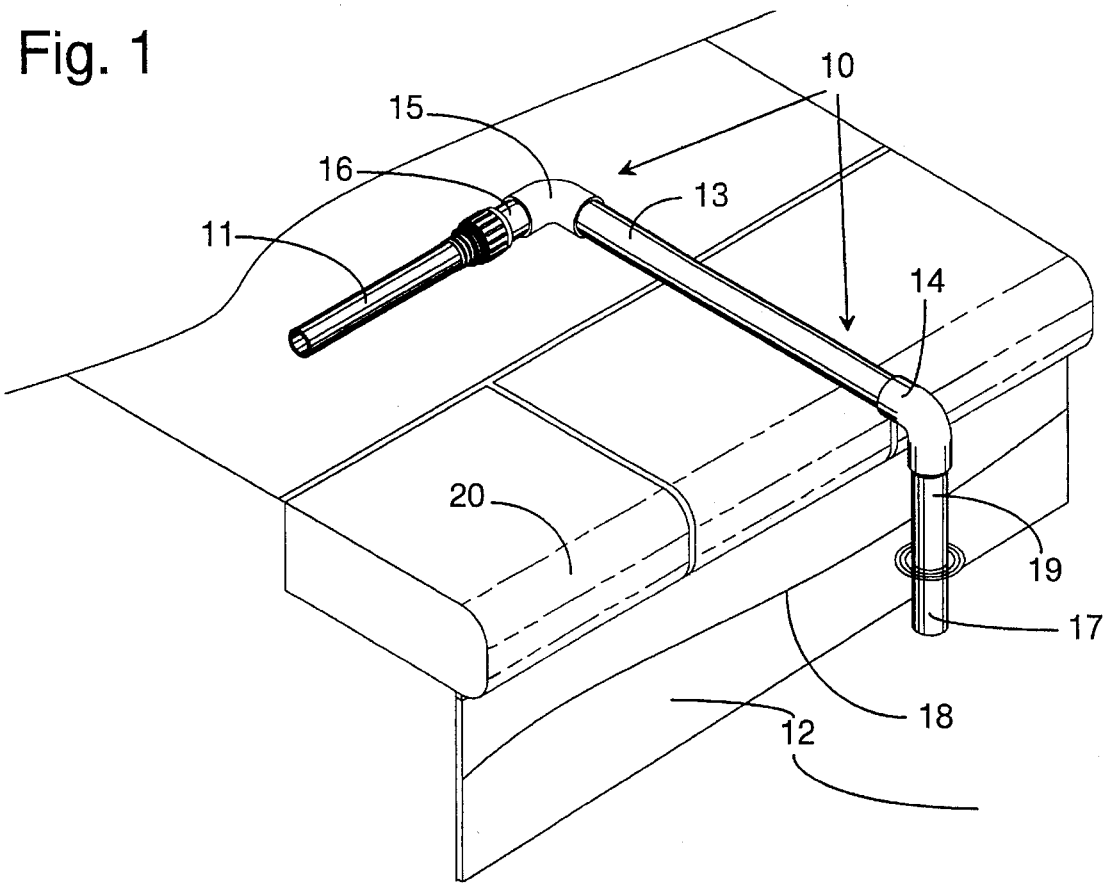
FIG. 1 is a diagrammatic perspective view of the instant invention setting on the edge of a pool with a portion of a garden hose connected and the soft threaded pick-up pipe reaching down to the water level.

Referring now to the drawings where embodiments of the siphon device according to this invention are illustrated in various drawings with the device assemblage generally referred to as siphon device 10. In the FIG. 1 illustration, siphon device 10 is shown assembled in a perspective view with a portion of a swimming pool illustrated representing, in addition, various other types of pools such as spas and the like. The device is comprised of several PVC fittings and pipe that when assembled connects to a garden hose 11 and hangs over the edge of a swimming pool 12. The long piece of poly plastic pipe 13 is, in this case, approximately 9" long and on either side are PVC 90 degree fittings 14 & 15. 14 is a half inch slip by female thread PVC 90, on the latter end 15 is a half by half slip PVC 90 with a 16 three quarter inch female hose swivel by half inch glued to the ninety degree bend. This latter ninety degree bend 15 or fitting plays a key role in the use and proper orientation of the device by keeping the device from rolling over and keeping the pick-up portion 17 of the device perpendicular to the water level 18. 16 is the necessary fitting required to attach a male end of a garden hose to. The half inch by eight inch long soft poly tubular pick-up pipe 19 connects or screws to 14 the half inch slip by female thread PVC 90, which 19 is the soft plastic piece threaded on one end that the user will cut off with a house knife at the point that will represent the users desired level of water in the pool once the unit 10 is set in place over the edge of the overfilled pool 20. It is to be noted that the size and lengths of the elements are only typical and that there is an infinite variation that may be selected as a matter of design choice.

Figure 2:
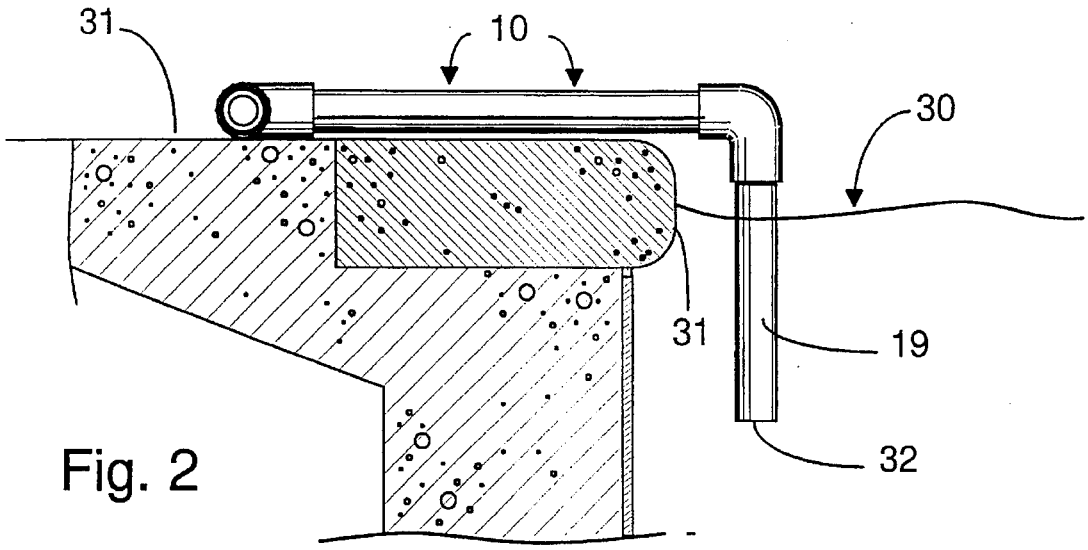
FIG. 2 is a sectional side view of a pool beam and coping with the water level line up to the middle of the coping. The instant invention is shown with the pick-up pipe protruding several inches below the surface of the water level.

In the FIG. 2 illustration, siphon device 10 is shown assembled in a side section view. Note the water level 30 in the illustration is half way up the pool coping 31 or overhang. The soft plastic piece 19 has been cut off with a house knife at the point 32 that represents the desired level of water in the pool.

Figure 3:
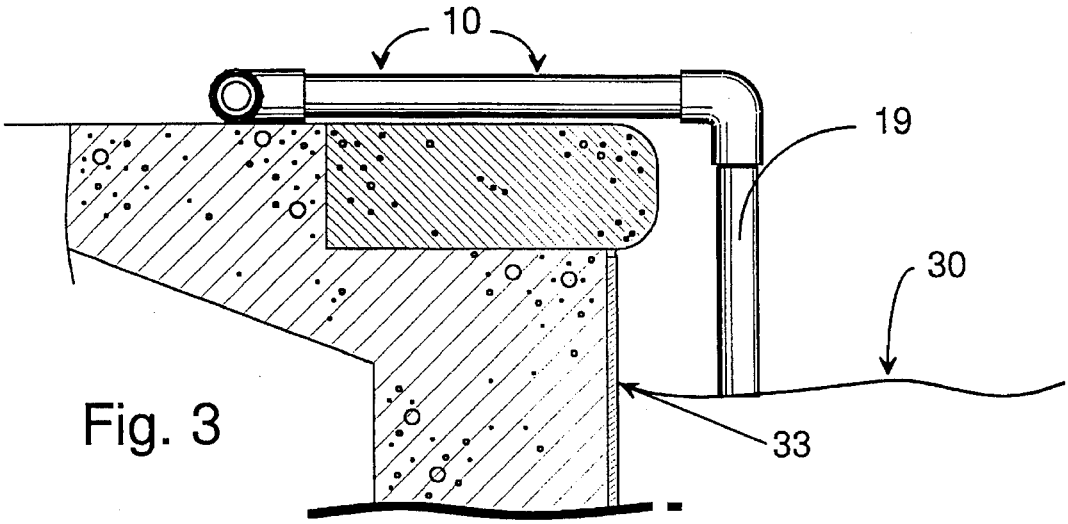
FIG. 3 is a sectional side view of a pool beam and coping with the water level line at a more desired location or approximately five inches below the patio deck. The instant invention is shown with the pick-up pipe terminating at the surface of the water level. A result of several hours of siphoning. At this point, no more siphoning can take place.

In the FIG. 3 illustration, siphon device 10 is shown assembled in a side section view. Note the water level 30 in the illustration is at the bottom of the pickup pipe 19 and has reached the desired level 33. At this point, the suction or siphon action is automatically terminated as air is introduced into the system through the bottom of the soft poly pick-up pipe 19.

Figure 4:
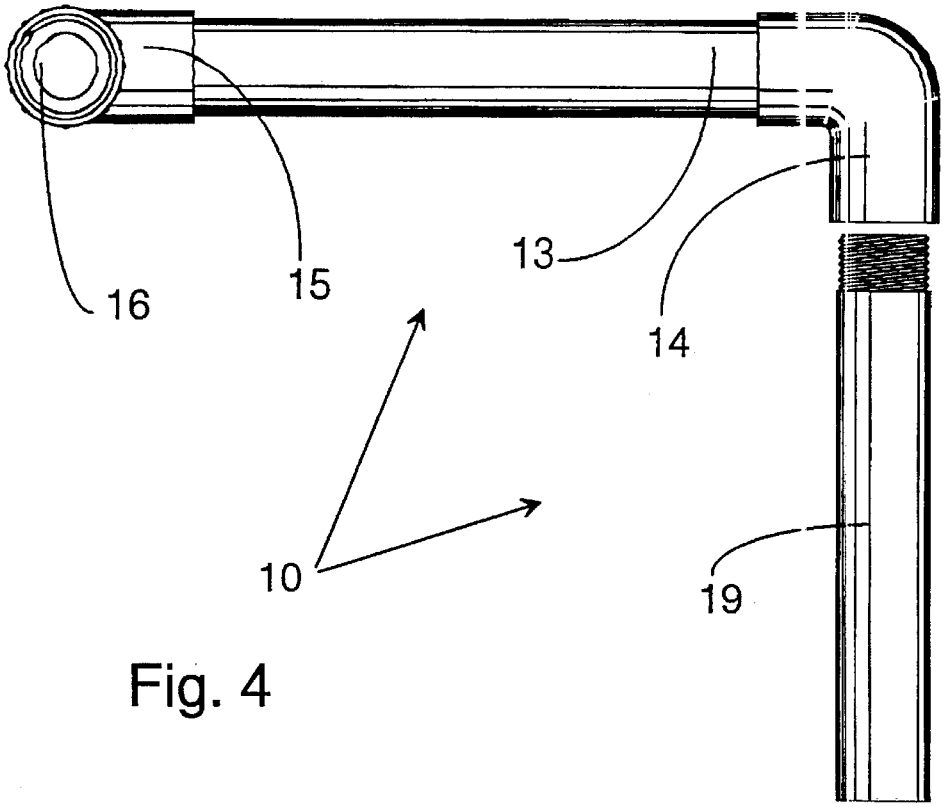
FIG. 4 is a side elevation view of a assembled pool siphon device.

In FIG. 4 component side view of the siphon device 10 are the elements of the device. Note element 19 exhibits male threads on one end and is screwed into 14 a half inch slip by female thread PVC 90. The long piece of ploy plastic pipe 13 is in this case, half inch SDR 13.5 315 PSI PVC pipe and is approximately 9" long. 15 is a half by half slip PVC 90 with a 16 three quarter inch female hose swivel by half inch glued to the half by half slip PVC 90 degree bend 15.

Figure 5:
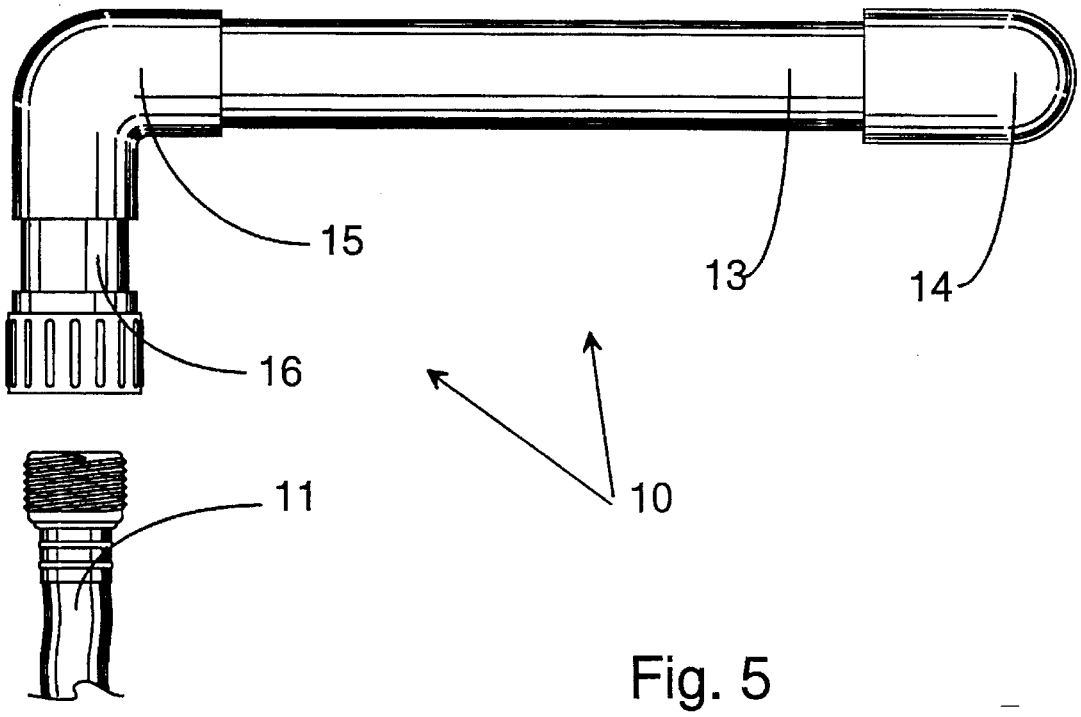
FIG. 5 is a top elevation view of a assembled pool siphon device and a male end of a garden hose indicating its attachment into the pool siphon device.

In FIG. 5 component top view of the siphon device 10 are the elements of the device plus a portion of a garden hose 11. Note item 14 a half inch slip by female thread PVC 90 attached to the long piece of PVC pipe 13 is in this case, half inch SDR 13.5 315 PSI PVC pipe and is approximately 9" long. 15 is a half by half slip PVC 90 with 16 a three quarter inch female hose swivel by half inch glued to the half by half slip PVC 90 degree bend 15.

SUMMARY, RAMIFICATIONS, AND SCOPE

The present invention provides a alternate and beneficial method of lowering ones water level in a pool at a very minimal cost. The benefits of using this device over pumping the water out with the pool pump would be: 1) healthier plants, grass and gardens 2) savings on the cost of water for refilling when over draining occurs 3) no need to closely monitor the pool draining operation 4) no washed out garden beds or mulch that has floated away, and 5) no soggy areas in the yard caused by the quantity of water drained. The cost of the device for consumers should be about ten dollars or less allowing this device to represent an affordable device for pool water lowering. Among the obvious unsightliness of an overflowing pool, it is desirable not to have the water level go above the tile line because water getting behind the tile (possible if a crack exists between the tile and the coping) or under the patio can cause voids and settling, likewise causing a unsupported patio or cracks in the patio.

Therefore, in practicing my invention, I have provided an auxiliary overflow draining device for swimming or other pools of water constructed of plastic components that are easily assembled by individuals at home. The small plastic tubular pipe device measures approximately 10" by 3" by 1" and consists of a slip by female thread PVC 90, a slip by slip PVC 90, a female hose swivel PVC adapter, an approximate eight inch long vertical soft plastic threaded tubular pipe to be shortened by user using a knife and a approximate 9" piece of PVC pipe.

Other forms and sizes of material used to construct this device are probable or likely.

Additionally supplied with the invention to the consumer would be a valved hose connector which is used or is helpful in maintaining proper fluids in the garden hose while the consumer is moving the end of the hose (furthest from the pool) to a low place in the yard which is necessary to start a gravity conceived siphon action.

The present invention is a small simple plastic tubular pipe device that is designed to connect to a regular garden hose and hang over the pool edge. The soft plastic pipe that extends vertically from the devise and into the water is to be cut-off by user with a knife at the point that represents the desired level of water for the pool. Upon filling of the garden hose with water and creating a natural gravity siphon action, water will be pulled or drained by or through the siphon device until the pool water level reaches the cut-off level of the soft plastic pipe. At which time, the introduction of air into the garden hose will cease the siphon action and likewise the pool will not be drained any further.

What is claimed as my invention is:

1. A siphon device used to lower the water level in a swimming pool to a predetermined level, said siphon device comprising a female garden hose connection fitting, said female garden hose fitting is connected to a tubular elbow fitting, said tubular elbow fitting to provide a steady non-rolling fixture and is connected to a horizontal support tube, said horizontal support tube lies parallel to the ground in a horizontal position and is connected to a vertically aimed tubular elbow fitting, said vertically aimed tubular elbow fitting exhibits a threaded connection, said threaded connection is for assembly of a soft plastic threaded tubular pipe that may be cut-off by user at any length, said soft plastic threaded tubular pipe extends vertically down into the swimming pool with the termination point submerged below the surface of the water, said soft plastic threaded tubular pipe having a length exceeding the distance between a top edge of the swimming pool coping and the swimming pool water level, said vertical soft plastic threaded tubular pipe is provided to allow user to cut-off a portion of said vertical soft plastic threaded tubular pipe at swimming pool water level that user determines to be adequate for users specific conditions and users own desires, hence when a garden hose filled with water is connected to the female garden hose connection and a portion of the garden hose is situated horizontally below the swimming pool water level the gravity induced drainage of the garden hose will continue to pull water from the swimming pool until the swimming pool water level reaches the termination point of said vertical soft plastic threaded tubular pipe.

* * * * *